United States Patent [19]

Iwahara

[11] 4,349,698

[45] Sep. 14, 1982

[54] AUDIO SIGNAL TRANSLATION WITH NO DELAY ELEMENTS

[75] Inventor: Makoto Iwahara, Yokohama, Japan

[73] Assignee: Victor Company of Japan, Limited, Yokohama, Japan

[21] Appl. No.: 160,543

[22] Filed: Jun. 18, 1980

[30] Foreign Application Priority Data

Jun. 19, 1979 [JP] Japan ..... 54-77275

[51] Int. Cl.[3] ..... H04S 1/00; H04S 5/00

[52] U.S. Cl. ..... 179/1 G; 179/1 GP

[58] Field of Search ..... 179/1 G, 1 GP, 1 GB, 179/1 GQ; 369/86, 87, 88, 89

[56] References Cited

U.S. PATENT DOCUMENTS 4,118,599 10/1978 Iwahara et al. ..... 179/1 G
4,192,969 3/1980 Iwahara et al. ..... 179/1 G
4,209,665 6/1980 Iwahara ..... 179/1 G
4,218,585 8/1980 Carver ..... 179/1 G

*Primary Examiner*—Douglas W. Olms
*Attorney, Agent, or Firm*—Lowe, King, Price & Becker

[57] ABSTRACT

Spatially correlated input audio signals are combined in a first combination of adder and subtracter to produce an input summation signal and an input difference signal, which are respectively translated by first and second filter circuits. The transfer function of the first filter circuit describes the relationship between the input summation signal and a summation of output audio signals and the transfer function of the second filter circuit describes the relationship between the input difference signal and a difference between the output audio signals. The translated signals are combined in a second combination of adder and subtracter to produce the output audio signals. Each of the filter circuits is designed with a minimum amount of phase shift which allows elimination of delay elements.

12 Claims, 29 Drawing Figures

AUDIO SIGNAL TRANSLATION WITH NO DELAY ELEMENTS

BACKGROUND OF THE INVENTION

The present invention relates to audio translators for translating spatially correlated signals into a form acceptable by a desired reproduction system or translating a monophonic signal into spatially correlated signals providing localization information without using delay circuit elements.

Since stereophonic signals derived from microphones spaced apart on a stage have different localization information from binaural signals derived from microphones mounted on a dummy head, reproduction of the stereophonic signals on a stereophonic headphone creates an acoustophysiological effect differing from that created by the same signals when the latter is reproduced on spaced apart loudspeakers. To achieve compatibility between stereophonic loudspeaker and binaural headphone systems, it is necessary to translate the input signals into a form acceptable by the reproduction arrangement. Prior art translators which have hitherto been proposed by the inventor for these purposes, however, involve the use of translating circuits whose transfer functions are given by the ratio B/A, where A is the transmission characteristic of an acoustic path from a loudspeaker to a listener's ear and B is the transmission characteristic of a crosstalk path between the speaker and the listener's other ear. Such translating circuits are only realized by delay circuits and filters due primarily to the time difference associated with the difference in acoustic transit time between the two acoustic paths. Since the delay elements tend to add complexity to circuit configuration with the resultant increase in cost, the prior art translators fall short of the ideal. The same situation occurs in a localization network which translates a monophonic signal into spatially correlated signals.

SUMMARY OF THE INVENTION

The primary object of the present invention is therefore to eliminate the need for delay circuit elements to allow simple circuit design for audio signal translators or sonic localization networks.

Since spatially correlated audio input signals, whether stereophonic or binaural, have a predetermined relationship with spatially correlated, translated audio output signals which are applied to a reproduction device (loudspeakers or stereophonic headphone), this relationship is expressed in terms of the ratio of a first transmission characteristic of sound waves impinging on a listener's ear to a second transmission characteristic of sound waves impinging on the listener's other ear. Summation of the input audio signals and subtraction of one from the other have also a predetermined relationship with summation and substraction of the translated audio signals. The present invention is based on the fact that the input summation and difference signals are respectively interrelated with the output summation and difference signals in terms of a multiplication factor which includes $1 \pm B/A$, where A and B respectively correspond to the first and second transmission characteristics referred to above. It is found by the inventor that this multiplication factor can be realized with a circuit which involves substantially no delay circuit elements. In a practical embodiment, this circuit is formed by a filter having a minimum amount of phase shift.

In a first embodiment of the invention, the audio signal translator comprises first and second adders serially connected in a first channel between first input and output terminals of the translator and first and second subtracters serially connected in a second channel between second input and output terminals of the translator. The adders and subtracter have their inputs cross-coupled to the first and second channels so that the output of the first adder is a summation of spatially correlated input audio signals and the output of the first subtracter is a difference between these input signals. A first translating circuit is connected in the first channel to provide a translation of the output of the first adder to the second adder and subtracter. This translating circuit is formed by a filter having a first transfer function describing the relationship between the output of the first adder and a summation of signals which appear at the translator output terminals. A second translating circuit is connected in the second channel to provide a translation of the output of the first subtracter to the second subtracter and adder. The second translating circuit is formed by a filter having a second transfer function describing the relationship between the output of the first subtracter and a difference between the signals at the translator output terminals.

The first and second translating circuits may be combined into a single filter circuit so that it provides a transfer function which is the division of the first transfer function by the second transfer function. This filter circuit is also designed to have a minimum amount of phase shift and connected in one of the first and second channels.

In a second embodiment of the invention, a sonic localization network is provided which comprises first and second filter circuits each having different transfer functions with a minimum amount of phase shift. A monophonic signal undergoes transformation by the first and second filter circuits to generate a pair of spatially correlated signals which are then coupled to the inputs of an adder and a subtractor and thence to a pair of output terminals.

BRIEF DESCRIPTION OF THE DRAWINGS

The present invention will be further described by way of example with reference to the accompanying drawings, in which.

and

Figure 27A:
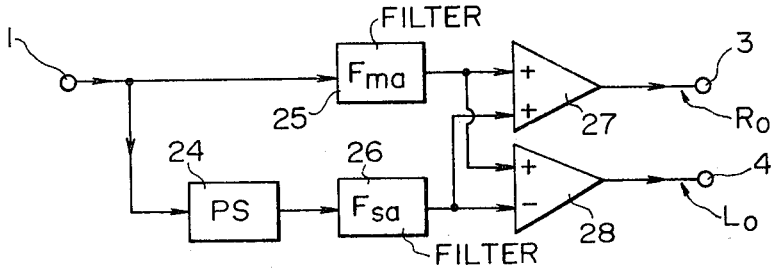
FIG. 27*a* is an illustration of a sonic localization network utilizing the transfer functions of the FIG. 8 embodiment.
Figure 27B:
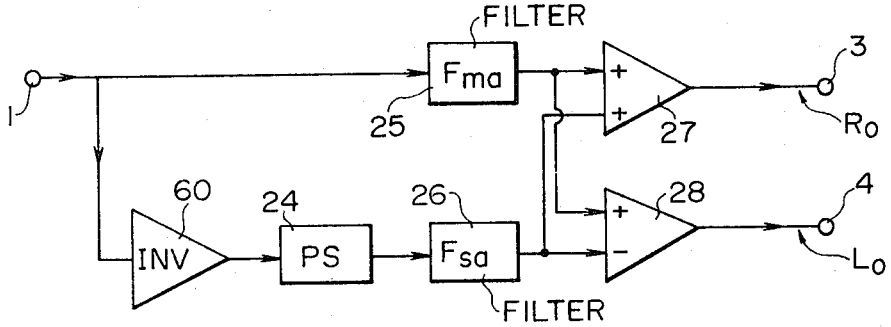
Figure 27C:
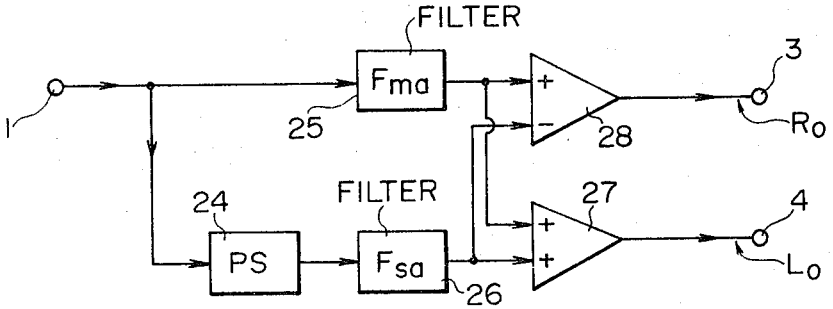

FIGS. 27*b* and 27*c* are illustrations of the modified forms of the FIG. 27*a* embodiment.

DETAILED DESCRIPTION

Figure 1:
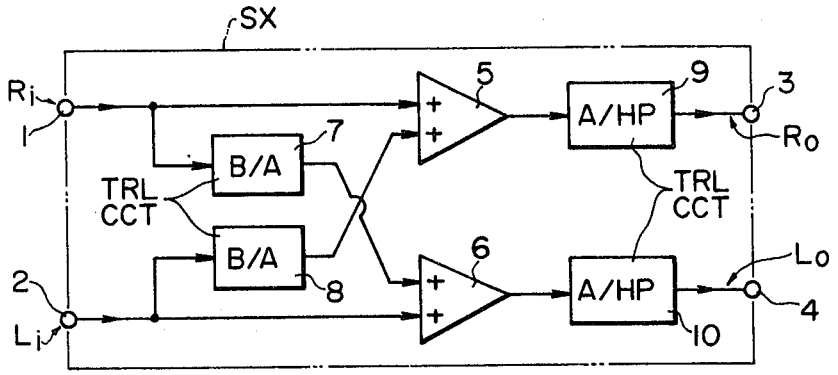
FIG. 1 PRIOR ART
FIG. 1 is a schematic illustration of a first prior embodiment which permits translation of stereophonic signals into binaural or headphone-adapted signals.
Figure 2:
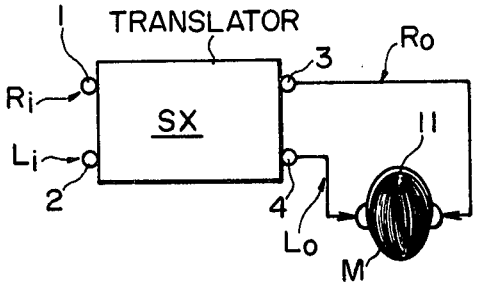
FIGS. 2 and 3 are schematic illustrations of arrangements associated with the prior art embodiment of FIG. 1.

Before going into the detail of the present invention reference is first had to FIGS. 1–7 in which a prior art audio signal translator is schematically illustrated. In FIG. 1, right- and left-channel audio input signals Ri and Li are supplied to input terminals 1 and 2, respectively, and undergo the signal translation and appear at right- and left-channel output terminals 3 and 4 as output signals Ro and Lo, respectively. The translator includes a pair of identical adders or summing amplifiers 5 and 6, each having one input terminal connected to the input terminal and another input connected through a translating circuit to the other input terminal. Each of the translating circuits 7 and 8 is designed to exhibit a transfer characteristic B/A, where A is a transfer function or characteristic of "near" acoustic paths between right and left speakers $SP_r$ and $SP_l$ (FIG. 3) to the right and left ears of a listener M located at equal distances from the speakers, and where B is a transfer function or characteristic of "far" acoustic paths (or crosstalk paths) between the speakers $SP_r$ and $SP_l$ and the left and right ears of the listeners, respectively. The right-channel input signal Ri is thus applied to one input of the adder 5 on the one hand an on the other to the adder 6 via the translating circuit 7, while the left-channel input signal Li is applied to one input of the adder 6 on the one hand and on the other to the adder 5 via the translating circuit 8. The outputs of the adders 5 and 6 are respectively coupled through translating circuits 9 and 10 to the output terminals 3 and 4. Each of the output translating circuits 9 and 10 is designed to exhibit a transfer characteristic A/HP where HP is a characteristic of a headphone 11 connected to the output terminals 3 and 4 as illustrated in FIG. 2, in which the listener M wears the headphone 11.

Figure 3:
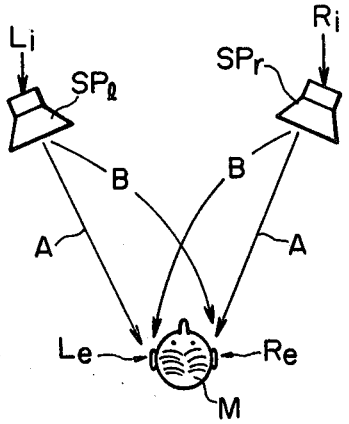

Assuming that the speakers $SP_r$ and $SP_l$ each have a flat frequency response characteristic and are in receipt of the audio input signals Ri and Li as illustrated in FIG. 3. With this arrangement, the signals Re and Le respectively impressed upon the right and left ears of the listener M can be expressed in terms of the transfer functions A and B as follows:

$$\begin{bmatrix} Re \\ Le \end{bmatrix} = \begin{bmatrix} A & B \\ B & A \end{bmatrix} \cdot \begin{bmatrix} Ri \\ Li \end{bmatrix} \tag{1}$$

In addition, the input-output relationship of the signal translator SX of FIG. 1 is given by Equation (2) and the relationship between the signals Re,Le and the translator output signals Ro,Lo is given by Equation (3).

$$\begin{bmatrix} Ro \\ Lo \end{bmatrix} = A/HP \begin{bmatrix} 1 & B/A \\ B/A & 1 \end{bmatrix} \cdot \begin{bmatrix} Ri \\ Li \end{bmatrix} \tag{2}$$

$$\begin{bmatrix} Re \\ Le \end{bmatrix} = HP \begin{bmatrix} Ro \\ Lo \end{bmatrix} \tag{3}$$

From Equations 2 and 3 the audio input signals Ri and Li have the following relationship with the ear-impressed signals Re and Le:

$$\begin{bmatrix} Re \\ Le \end{bmatrix} = HP \cdot A/HP \begin{bmatrix} 1 & B/A \\ B/A & 1 \end{bmatrix} \cdot \begin{bmatrix} Ri \\ Li \end{bmatrix}$$

therefore, $$\begin{bmatrix} Re \\ Le \end{bmatrix} = \begin{bmatrix} A & B \\ B & A \end{bmatrix} \cdot \begin{bmatrix} Ri \\ Li \end{bmatrix} \tag{4}$$

Since Equation 4 is equal to Equation 1, it implies that the translator SX permits the listener to have the same acoustophysiological impression whether he hears sound through the headphone 11 or from the speakers $SP_r$ and $SP_l$ in the respective arrangements of FIGS. 2 and 3.

Figure 4:
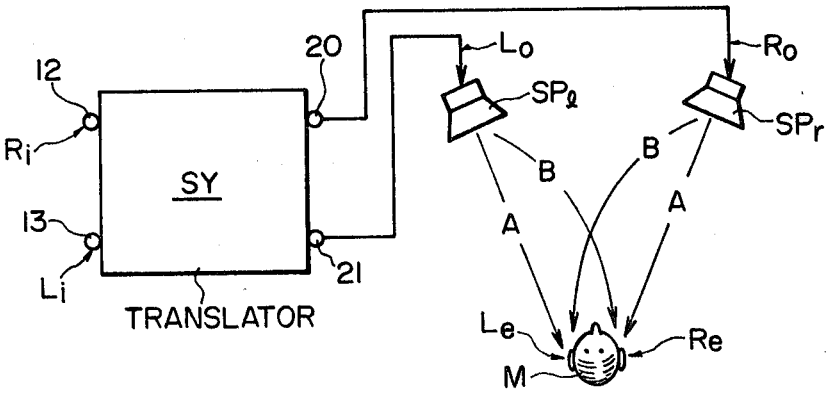
FIG. 4 is a schematic illustration of a second prior art embodiment which permits translation of binaural signals into stereophonic, or speaker-adapted signals.

As described above, each of the translating circuits 7 and 8 exhibits the ratio of transfer function B of the far acoutic path to transfer function A of the near acoustic path. However, this transfer function B/A is found to have a greater amount of attenuation in the higher frequency range of the audio spectrum than in the lower frequency range as a result of diffraction of acoustic waves travelling over the passages near the listener's ears, and in addition, it contains a delay time corresponding to the difference in length between the near and far acoustic paths. Therefore, in a practical embodiment, the translating circuits 7, 8 is constituted by a high-frequency attenuating filter and a delay circuit in a cascaded connection. Otherwise stated, the prior art translator of FIG. 1 allows reproduction of the same stereophonic effect by means of a stereophonic headphone as that which would be obtained if the signals Ri and Li were supplied to loudspeakers. In the circuit of FIG. 1 the localization of sonic images is created by the translating circuits 7 and 8. The characteristic of the circuits 9 and 10, on the other hand, serves to determine the sound quality of the output signals and requires no delay circuits in its place;

The circuit shown in FIG. 4 is a second embodiment of the prior art translator which is designed to permit binaural signals to be reproduced through loudspeakers to create the same acoustophysiological effect as that which would be obtained if the binaural signals were supplied to a stereophonic headphone. In FIG. 4 the signal translator SY is designed to have the following transfer function:

$$Y = \begin{bmatrix} A & B \\ B & A \end{bmatrix}^{-1} \quad \text{(y)}$$

The relationship between binaural input signals Ri,Li and the signals Re,Le impressed on the listener's ears is given as follows:

$$\begin{bmatrix} Re \\ Le \end{bmatrix} = \begin{bmatrix} A & B \\ B & A \end{bmatrix} \cdot Y \cdot \begin{bmatrix} Ri \\ Li \end{bmatrix} \quad (5)$$

Therefore, $$\begin{bmatrix} Re \\ Le \end{bmatrix} = \begin{bmatrix} A & B \\ B & A \end{bmatrix} \cdot \begin{bmatrix} A & B \\ B & A \end{bmatrix}^{-1} \cdot \begin{bmatrix} Ri \\ Li \end{bmatrix}$$

hence, $$\begin{bmatrix} Re \\ Le \end{bmatrix} = \begin{bmatrix} Ri \\ Li \end{bmatrix} \quad (6)$$

Figure 5:
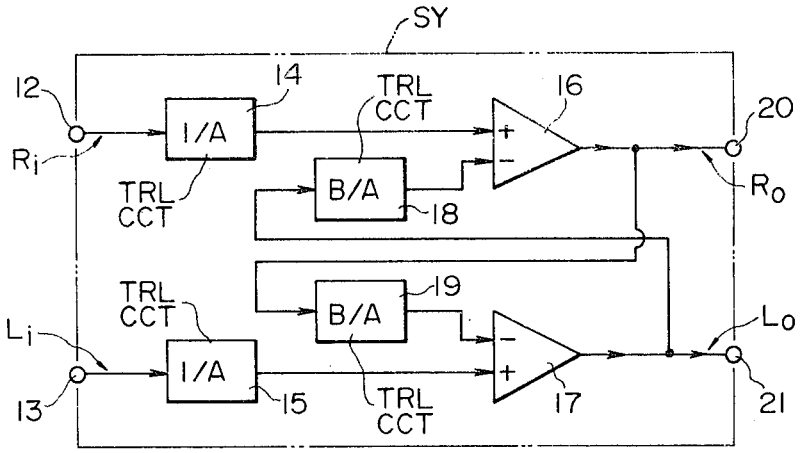
FIG. 5 PRIOR ART
FIG. 5 is an illustration of the translator of FIG. 4.

The transfer characteristic Y can be realized by a circuit SY shown in FIG. 5 in which the input signals Ri and and Li are applied to terminals 12 and 13 and thence through translating circuits 14 and 15, respectively, to positive input terminals of subtractors 16 and 17. The output terminals of the subtractors 16 and 17 are cross-coupled so that the output of each is connected to the negative input of the other through a translating circuit 18 or 19, the outputs of the subtractors 16 and 17 being further coupled to output terminals 20 and 21, respectively, at which output signals Ro and Lo appear. Each of the translating circuits 14 and 15 is designed to have a transfer function 1/A, while each of the translating circuits 18 and 19 is designed to have a transfer function B/A. The validity of the transfer function Y is verified by the following Equations which establish an input-output relationship of the circuit of FIG. 5:

$$\left.\begin{aligned} Ro &= \frac{1}{A} Ri - \frac{1}{A} \cdot \frac{B}{A} \cdot A \cdot Lo \\ Lo &= \frac{1}{A} Li - \frac{1}{A} \cdot \frac{B}{A} \cdot A \cdot Ro \end{aligned}\right\} \quad (7)$$

$$Ro + \frac{B}{A} Lo = \frac{1}{A} Ri$$

$$Lo + \frac{B}{A} Ro = \frac{1}{A} Li$$

Therefore, $$\begin{bmatrix} 1 & B/A \\ B/A & 1 \end{bmatrix} \cdot \begin{bmatrix} Ro \\ Lo \end{bmatrix} = \frac{1}{A} \begin{bmatrix} Ri \\ Li \end{bmatrix}$$

which is rearranged as follows:

$$\begin{bmatrix} Ri \\ Li \end{bmatrix} = \begin{bmatrix} A & B \\ B & A \end{bmatrix} \cdot \begin{bmatrix} Ro \\ Lo \end{bmatrix} \quad (7a)$$

hence, $$\begin{bmatrix} Ro \\ Lo \end{bmatrix} = \begin{bmatrix} A & B \\ B & A \end{bmatrix}^{-1} \cdot \begin{bmatrix} Ri \\ Li \end{bmatrix} \quad (7y)$$

Equation 7y implies that the transfer function Y is validly represented by Equation (y), and it is apparent that the translator SY provides conversion of speaker-reproduction stereophonic signals into headphone-reproduction stereophonic signals. Since the transfer function of each translating circuit 18 or 19 is formed by a high-frequency attenuating filter and a delay circuit in a cascaded connection as in the circuit SX of FIG. 1, it is impossible to avoid complexity of the circuits 18 and 19.

Figure 6:
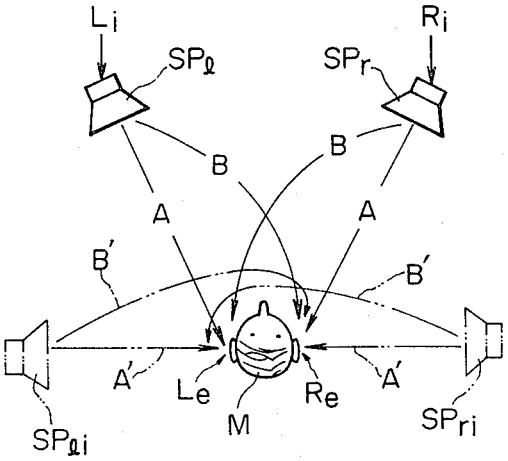
FIG. 6 is a schematic illustration of an arrangement describing the transmission characteristics of virtual and hypothetical acoustic paths.
Figure 7:
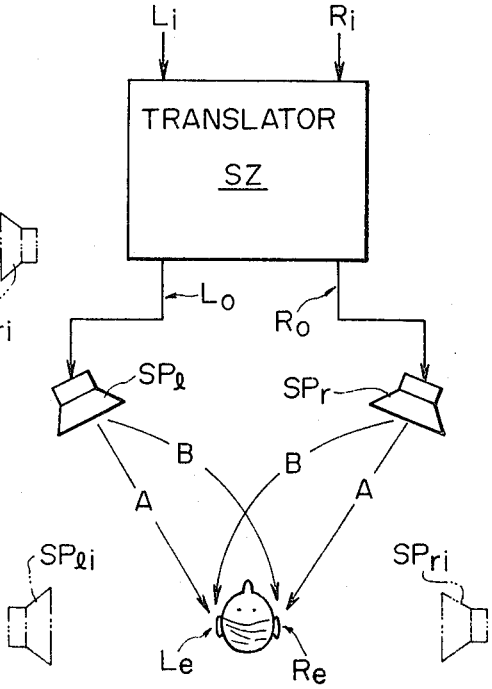
FIG. 7 is a schematic illustration of a third prior art embodiment which permits expansion of stage width.

A similar state of affairs occurs in a system which permits the listener to have the impression of an expanded stage width. More specifically, if the listener is made to hear sound as if it comes from hypothetical speakers $SPr_1$ and $SPl_1$ rather than from actual speakers SPr and SPl as illustrated in FIG. 6, in which the direct and crosstalk transfer functions of the hypothetical speakers with respect to the listener's ears are designated A' and B', respectively. The same desig-nation are used for the transfer functions of the actual speakers as used in the previous prior art embodiments. The input-output relationships of the arrangements of FIGS. 7 and 6 are respectively given by the following Equations 8 and 9. From these Equations the transfer function of the signal translator SZ of FIG. 7 is given by Equation 10.

$$\begin{bmatrix} Re \\ Le \end{bmatrix} = \begin{bmatrix} A & B \\ B & A \end{bmatrix} \cdot \begin{bmatrix} Ro \\ Lo \end{bmatrix} \quad (8)$$

$$\begin{bmatrix} Re \\ Le \end{bmatrix} = \begin{bmatrix} A' & B' \\ B' & A' \end{bmatrix} \cdot \begin{bmatrix} Ri \\ Li \end{bmatrix} \quad (9)$$

$$Z = \begin{bmatrix} A & B \\ B & A \end{bmatrix}^{-1} \cdot \begin{bmatrix} A' & B' \\ B' & A' \end{bmatrix} \quad (10)$$

where, z represents the transfer function of the translator SZ.

As is apparent from Equation 10, the signal translator SZ can be realized by a cascaded connection of the translator SX of FIG. 1 and the translator SY of FIG. 5. Therefore, as in the previous prior art embodiments the necessity of a delay circuit cannot be avoided.

In the prior art embodiments, sonic localization which is a measure of realism, is achieved by a symmetically constructed translator. The present invention is also based on this symmetry, but deviates from the prior art by performing the subtraction and summation of input signals before the signals undergo translation.

First consider Equation 2 which can be rearranged as follows:

$$Ro = \frac{A}{HP}\left(Ri + \frac{B}{A}Li\right) \quad (2a)$$

$$Lo = \frac{A}{HP}\left(Li + \frac{B}{A}Ri\right) \quad (2b)$$

These Equations can be further rearranged as:

$$(Ro + Lo) = \frac{A}{HP}\left(1 + \frac{B}{A}\right)(Ri + Li) \quad (11)$$

$$(Ro - Lo) = \frac{A}{HP}\left(1 - \frac{B}{A}\right)(Ri - Li) \quad (12)$$

Equation 11 implies that the summation of output signals is equal to the summation of input signals multiplied by a factor (A/HP) (1+(B/A)), while Equation 12 implies that a difference output is equal to a difference input multiplied by a factor (A/HP) (1−(B/A)). The information that bears on sonic localization is represented by the ratio of the multiplication factor of Equation 12 to that of Equation 11. Since the characteristic A/HP only serves to determine tone and bears no information as to sonic localization, the following Equation gives a clue to the information on the localization of sonic images:

$$\frac{\frac{A}{HP}\left(1 - \frac{B}{A}\right)}{\frac{A}{HP}\left(1 + \frac{B}{A}\right)} = \frac{\left(1 - \frac{B}{A}\right)}{\left(1 + \frac{B}{A}\right)} = \frac{Fsa}{Fma} \quad (13)$$

Figure 9:
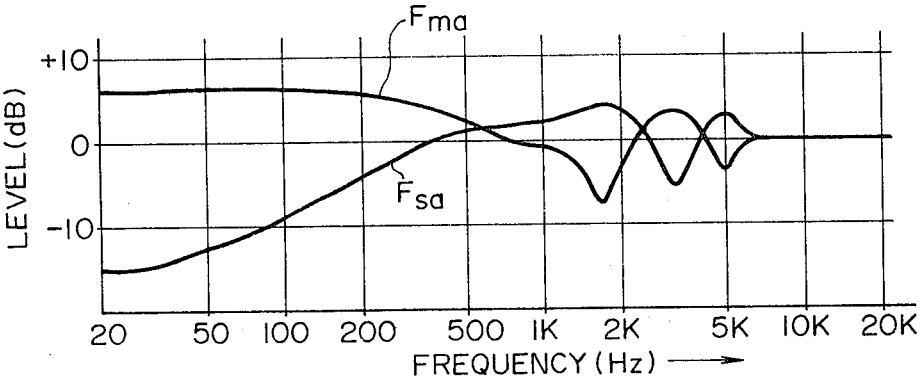
FIG. 9 is a graphical illustration of the frequency response characteristics of translating circuits of FIG. 8.
Figure 10:
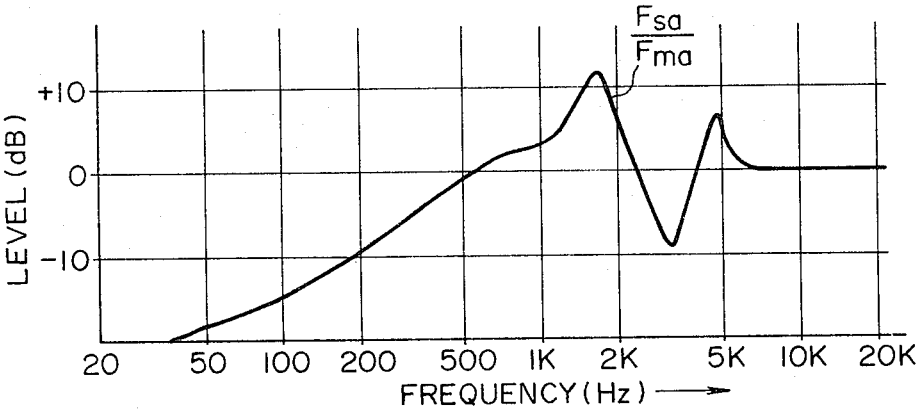
FIG. 10 is a graphical illustration of the ratio of the frequency response characteristics or transfer functions of FIG. 9.

The transfer functions Fsa and Fma are shown in FIG. 9 and their ratio is illustrated in FIG. 10. These characteristics are obtained based on a calculation substituting the transfer characteristics of A and B into Equation 13, the characteristics A and B being obtained with respect to a listener sitting at a location which subtends an angle of 60 degrees to a pair of right and left speakers. It is found that by comparison with the B/A transmission characteristic that is employed in the prior art translators there is substantially no element of delay in the characteristics Fsa and Fma.

Figure 8:
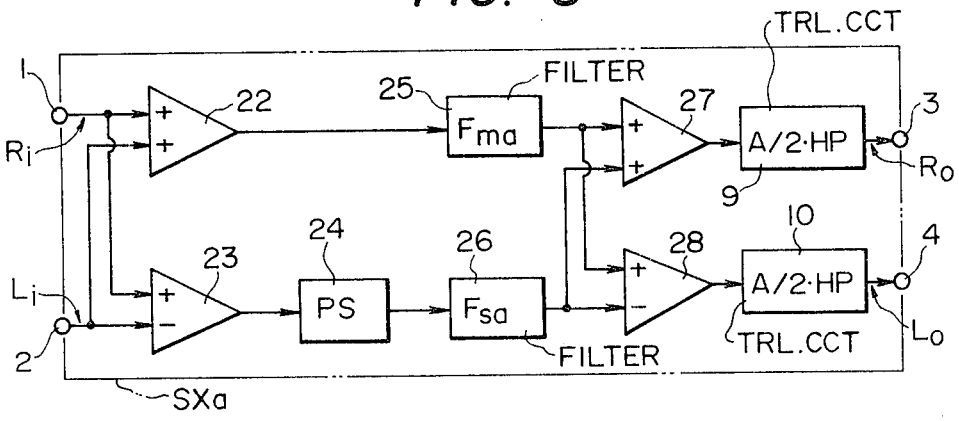
FIG. 8 is an illustration of a first preferred embodiment of the invention.

A signal translator incorporating Equation 13 will now be described. A circuit shown in FIG. 8 is constructed in accordance with the invention and corresponds to the prior art translator of FIG. 1 in terms of functions which provide conversion of speaker reproduction stereophonic signals into headphone reproduction stereophonic signals.

The translator $SX_a$ comprises an adder 22 and a subtractor 23 whose inputs are cross-coupled to the input terminals 1 and 2 so that the output of the adder 22 is a summation of input stereophonic signals Ri and Li and the output of the subtractor 23 is a difference between the input signals, that is (Ri−Li). The output of the adder 22 is connected to a first filter 25 having a frequency response characteristic Fma, and the output of the subtracter 23 is connected, preferably, via a phase shifter 24 to a second filter 26 having a frequency response characteristic Fsa. Each of the filters 25 and 26 is designed to have a minimum amount of phase shift and follow the respective curve of FIG. 9. The outputs of the filters 25 and 26 are cross-coupled to the inputs of an adder 27 and a subtracter 28 so that the adder 27 provides a summation signal of the outputs of the filters 25, 26 and the subtracter 28 provides a difference between the outputs of these filters. The outputs of the adder 27 and subtracter 28 are respectively coupled to the output terminals 3 and 4 of the translator via translating circuits 9 and 10 each having a transfer function A/(2·HP).

By application of in put signals Ri and Li to the input terminals 1 and 2, the output of the adder 25 becomes $$2\left(Ri + \frac{B}{A}Li\right)$$

and therefore $$Ro = \left(Ri + \frac{B}{A}Li\right)\frac{A}{HP}.$$

Similarly, the output of the subtracter 28 becomes $$2\left(Li + \frac{B}{A}Ri\right)$$

and therefore $$Lo = \left(Li + \frac{B}{A}Ri\right)\frac{A}{HP}.$$

Thus, combined signals (Ro+Lo) and (Ro−Lo) correspond respectively to those obtained by Equations 11 and 12. The audio translator $SX_a$ of FIG. 8 thus provides the same sonic localization as the translator SX of FIG. 1, but with the use of no delay circuit components.

According to experiments it is found that the output signal of the translator tends to shift in a low frequency range of the audio spectrum. As illustrated by curve I of FIG. 11, the amount of phase shift increases as an inverse function of audio frequency (where the frequency response characteristic of the translator is assumed to be made flat as indicated at II). The phase shifter 24 is provided for the purpose of compensating for this phase shift. However, this phase shifter may be dispensed with under certain circumstances if the listener's sensitivity to sonic localization in the lower frequency range is relatively low.

Figure 11:
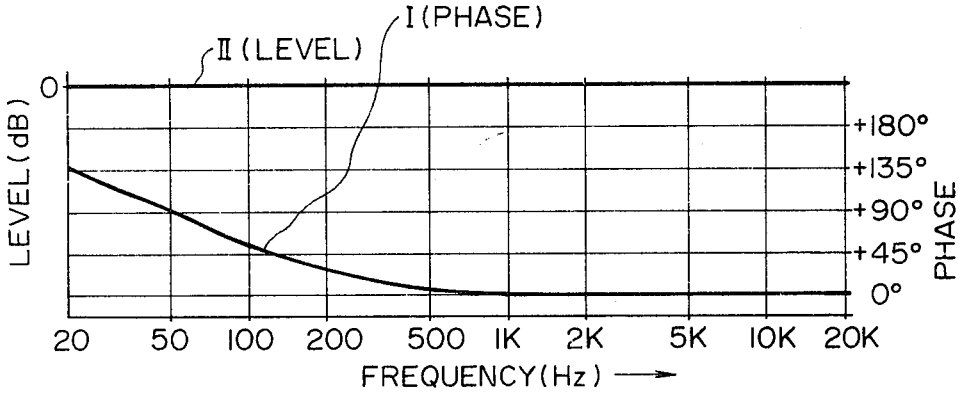
FIG. 11 is a graphical illustration of the phase shift characteristic of the translating circuits of FIG. 8 when the frequency response characteristics thereof are made flat.
Figure 12:
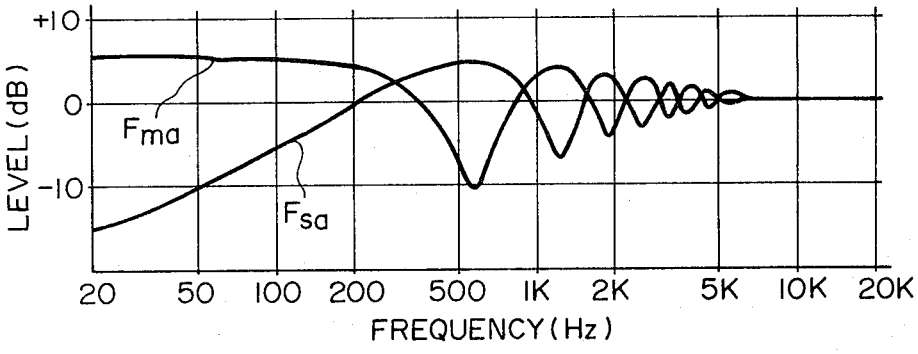
FIGS. 12 to 14 are graphical illustrations of frequency response and phase shift characteristics obtained on the basis of an arrangement in which loudspeakers are located laterally of a listener and correspond respectively to the graphical illustrations of FIGS. 9, 10 and 11.
Figure 13:
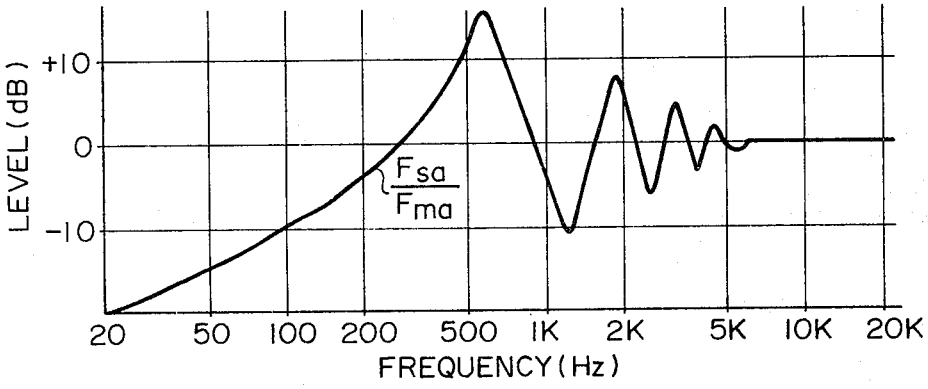
Figure 14:
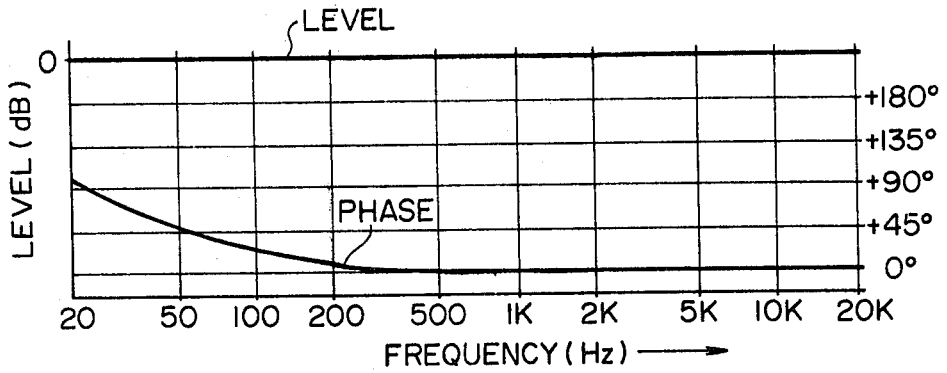

As illustrated in FIGS. 12 to 14, substantially the same results are obtained whtn the speakers are located laterally of the listener's ears as the results shown in FIGS. 9 to 11. The lower frequency phase shift is apparently less acute than that obtained with respect to the previous listener's location.

Figure 15:
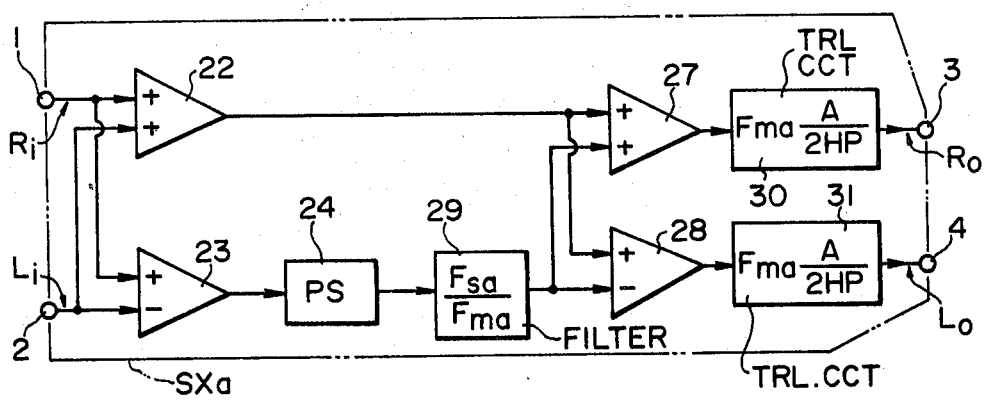
FIG. 15 is an illustration of a modification of the embodiment of FIG. 8.

FIG. 15 shows a modification of the embodiment of FIG. 8. In this modified translator, the output of the adder 22 is directly applied to the adder 27 whose output is connected to a translating circuit 30 having a transfer function represented by $$Fma \frac{A}{2HP}$$

and the circuit 26 of FIG. 8 is replaced with a translating circuit 29 having a transfer function Fsa/Fma, the output of the subtracter 28 being coupled to a translating circuit 31 having the same transfer function as the circuit 30.

Although the circuit configuration differs from the FIG. 8 embodiment, the translating characteristic of the FIG. 15 embodiment is the same as the former. If the translating circuits 30 and 31 are removed from the translator of FIG. 15, the summation signal of Ri and Li undergoes no changes in frequency response characteristic, so that the sonic image in the center stage is not affected in sound quality.

Figure 16:
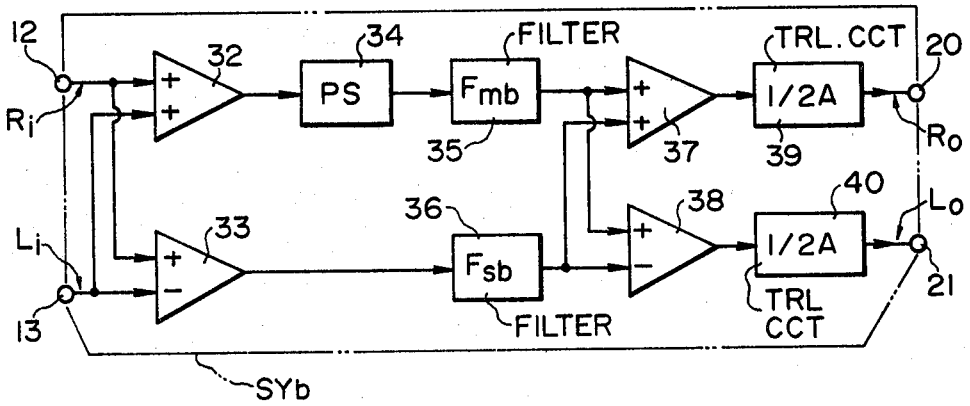
FIG. 16 is an illustration of a second preferred embodiment of the invention.

A second embodiment of the present invention is illustrated in FIG. 16 which corresponds to the prior art embodiment of FIG. 5. Since Equation *7a* can be rearranged as follows, $$Ri = A\left(Ro + \frac{B}{A} Lo\right) \tag{7b}$$

$$Li = A\left(Lo + \frac{B}{A} Ro\right) \tag{7c}$$

summation and difference signals can be obtained as follows:

$$(Ri + Li) = A\left(1 + \frac{B}{A}\right)(Ro + Lo)$$

therefore, $$(Ro + Lo) = \frac{1}{A} \frac{1}{\left(1 + \frac{B}{A}\right)} (Ri + Li) \tag{14}$$

Likewise, $$(Ri - Li) = A\left(1 - \frac{B}{A}\right)(Ro - Lo)$$

therefore, $$(Ro - Lo) = \frac{1}{A} \frac{1}{\left(1 - \frac{B}{A}\right)} (Ri - Li) \tag{15}$$

In a similar manner to that described in the first preferred embodiment, the multiplication factors $$1/\left(1 + \frac{B}{A}\right) \text{ and } 1/\left(1 - \frac{B}{A}\right)$$

bear information as to the localization of sonic images. If $$Fmb = 1/\left(1 + \frac{B}{A}\right) \text{ and } Fsb = 1\left(1 - \frac{B}{A}\right),$$

the ratio Fsb/Fmb is given by $$\frac{Fsb}{Fmb} = \frac{1 + (B/A)}{1 - (B/A)} \tag{16}$$

Figure 17:
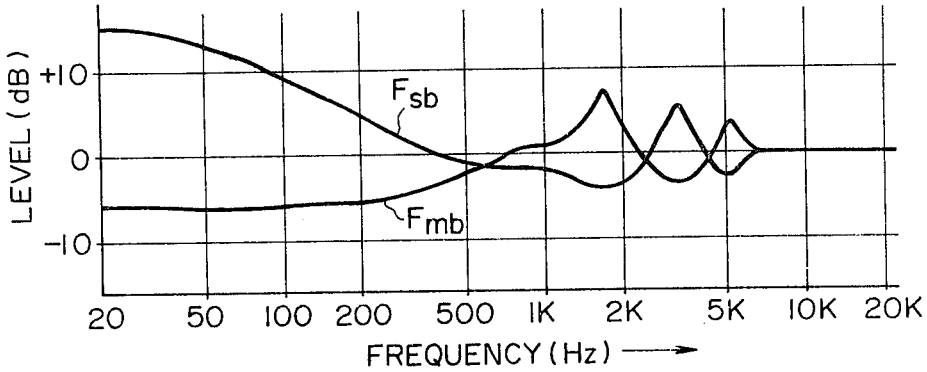
FIGS. 17 to 19 are graphical illustrations of the frequency response and phase shift characteristics of the FIG. 16 embodiment.
Figure 18:
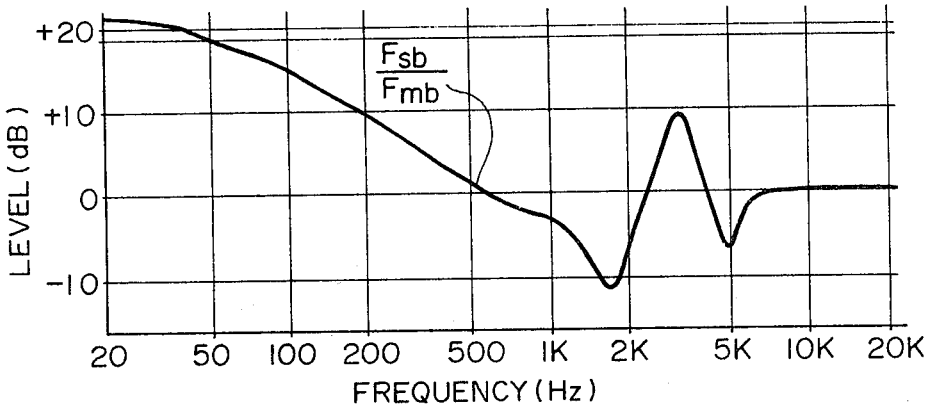

FIG. 17 is an illustration of the frequency response characteristics of transfer functions Fmb and Fsb, and FIG. 18 depicts the ratio Fsb/Fmb. The translator $SY_b$ of FIG. 16 comprises an adder 32 and a subtracter 33 with their input terminals being cross-coupled to the input terminals 12 and 13. A translating circuit 36 which is in receipt of its input signal from the output of the adder 32, is designed to possess the response characteristic of the transfer function Fmb. Another translating circuit 36 connected to the output of the subtracter 33, is designed to possess the characteristic of the transfer function Fsb. An adder 37 and a subtracter 38 have their input terminals cross-coupled to the outputs of the translating circuits 35, 36 so that the adder 37 provides an output signal $2A(ARi-BLi)/(A^2-B^2)$ and the subtracter 38 an output signal $2\ A(ALi-BRi)/(A^2-B^2)$. The outputs of the adder 37 and subtracter 38 are coupled respectively to translating circuits 39 and 40, each having a transfer function (1/2A). Therefore, the output signals Ro and Lo which appears at terminals 20 and 21 are represented by $(ARi-BLi)/(A^2-B^2)$ and $(ALi-BRi)/(A^2-B^2)$, respectively, which would result in combined signals (Ro+Lo) and (Ro−Lo) which respectively satisfy Equations 14 and 15.

Figure 19:
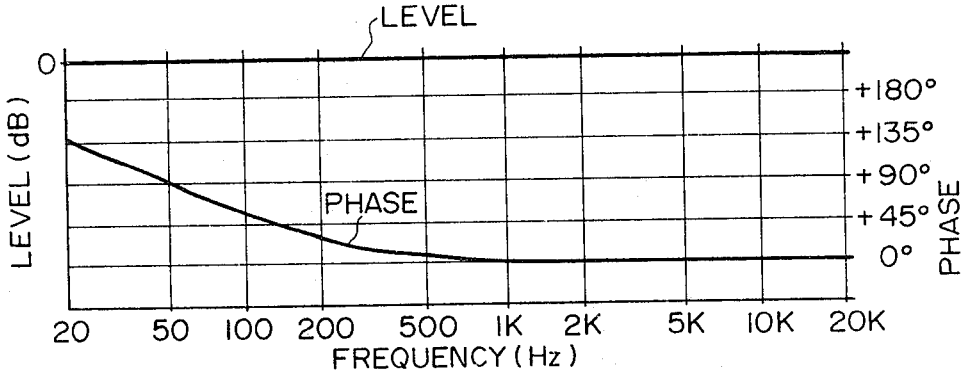

The translating circuits 35 and 36 are each formed by a filter having a minimum amount of phase shift, thus eliminating the need for the provision of a delay element, as in the previous embodiment. FIG. 19 illustrates the amount of phase shift which occurs in the lower frequency range of the spectrum. This frequency dependent phase shift is compensated for by the phase shifter 34.

Figure 20:
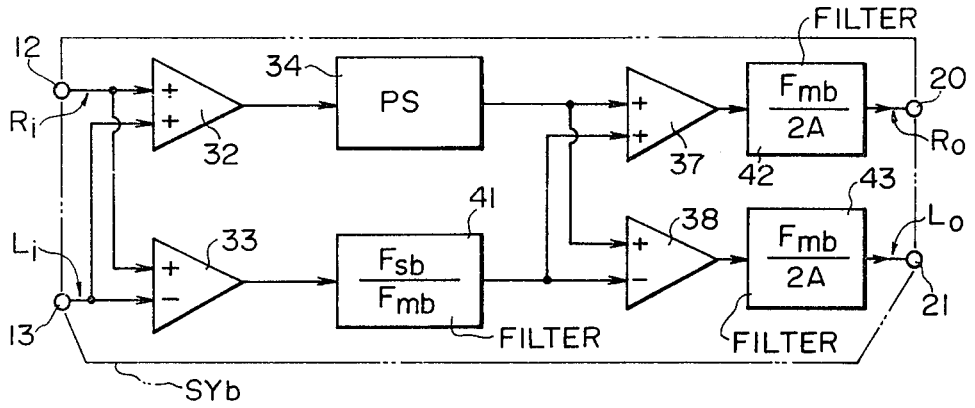
FIG. 20 is an illustration of a modification of the FIG. 16 embodiment.

The embodiment of FIG. 16 is modified as shown in FIG. 20 in which a translating circuit 41 provides a translation Fsb/Fmb whose characteristic is illustrated in FIG. 18 and translating circuits 42, 43 each having (Fmb/2A) replace the translating circuits 39 and 40 of FIG. 16. This circuit arrangement is also capable of eliminating the need for providing delay elements. If the output translating circuits 42 and 43 are removed from the translator $SY_b$, the summation signal (Ri+Li) undergoes no change in frequency characteristic, so that it appears unaffected at the output terminals 20 and 21. This implies that the sound component coming from the center stage of a reproduction field is not affected by the transfer function Fmb or Fsb so that its sound quality is substantially a replica of the original sound in the center stage of the original field.

Figure 21:
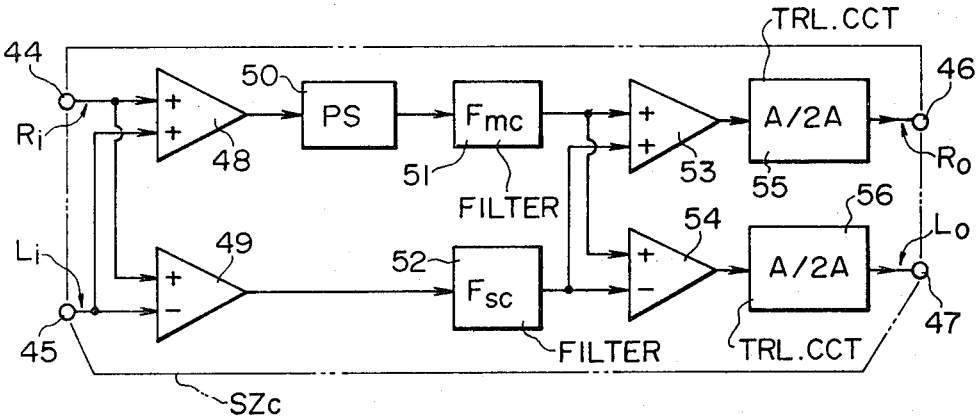
FIG. 21 is an illustration of a third preferred embodiment of the invention.

A third embodiment of the present invention is illustrated in FIG. 21 which is an improvement over the prior art embodiment of FIG. 7 in which stage width expansion effect is provided.

Figure 22:
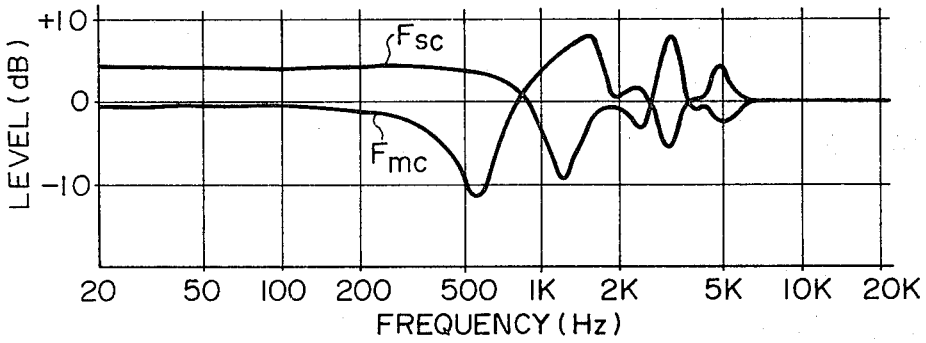
FIGS. 22 to 24 are graphical illustrations of the frequency response and phase shift characteristics of the FIG. 21 embodiment.

In FIG. 21, the translator $SZ_c$ comprises an adder 48 and a subtracter 49 each of which has its inputs cross-coupled to input terminals 44 and 45. The output of the adder 48 is connected via a phase shifter 50 to a translating circuit 51 and thence to an input of an adder 53 whose other input is connected to the output of a translating circuit 52. The output of the subtracter 49 is connected through the translating circuit 52 to an input of a subtracter 54 whose another input is connected to the output of the translating circuit 51. The outputs of the adder 53 and subtracter 54 are coupled to circuits 55, 56 each having a function A'/2A and thence to output terminals 46,47. The translating circuits 51 and 52 are each formed of a filter having a minimum amount of phase shift. The frequency response characteristic Fmc of the translating circuit 51 is illustrated in FIG. 22 which is obtained by the combination of the transfer functions Fma and Fmb. Similarly, the frequency response characteristic Fsc of the translating circuit 52 is illustrated also in FIG. 22 which is obtained by the combination of the transfer functions Fsa and Fsb. From a practical standpoint, the translating circuits 55 and 56 can be dispensed with because the transfer function A is substantially equal to the transfer function A', and further the phase shifter 50 can also be dispensed with for the same reason stated previously.

Figure 23:
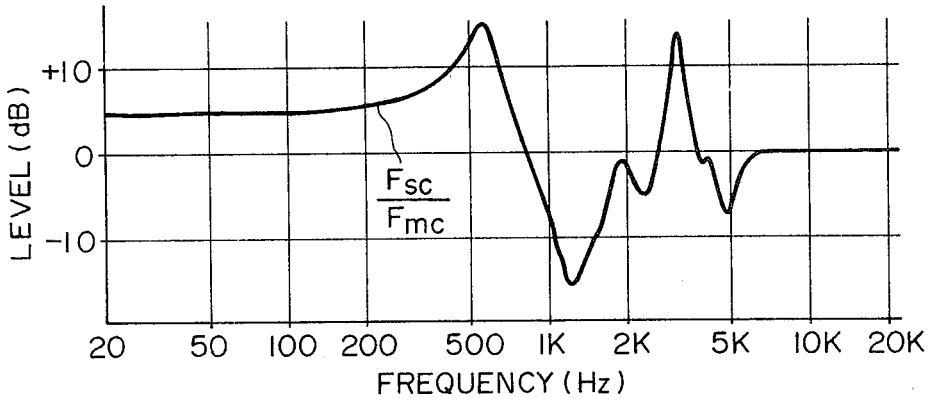
Figure 24:
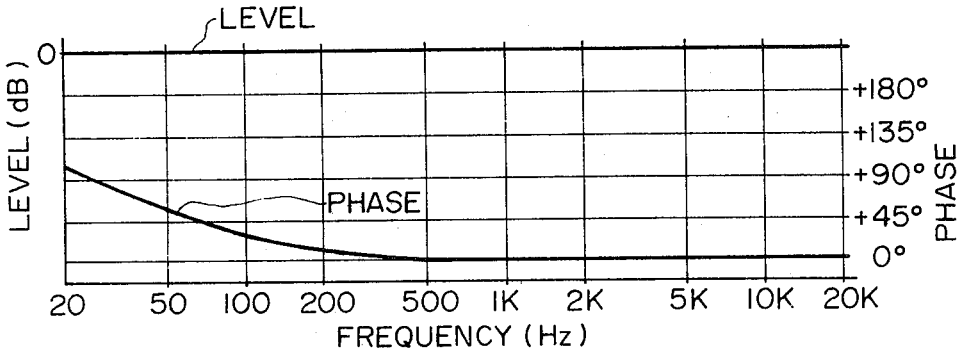
Figure 25:
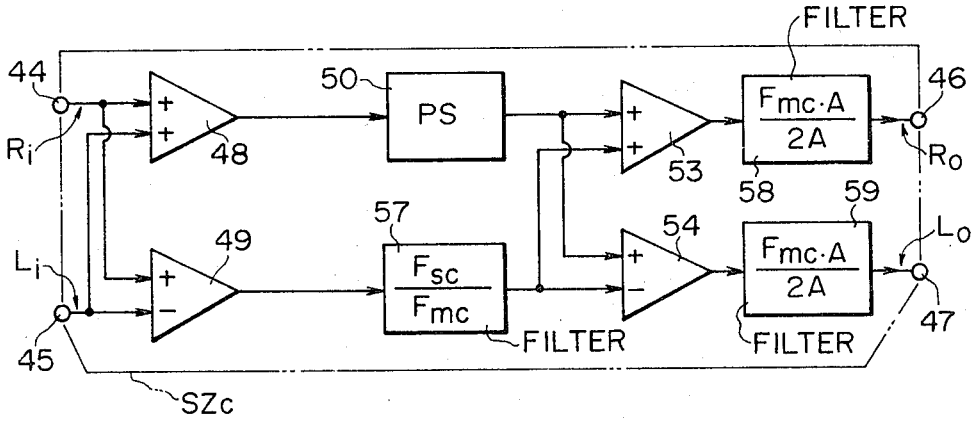
FIG. 25 is a illustration of a modification of the FIG. 21 embodiment.

FIG. 25 is an illustration of a modification of the embodiment of FIG. 21 in which a translating circuit 57 is connected to the output of the subtracter 49 and translating circuits 58 and 59 replace the circuits 55 and 56 of FIG. 21. The translating circuit 57 is formed of a filter having a minimum amount of phase shift with a characteristic represented by the ratio Fsc/Fmc as illustrated in FIG. 23. The output translating circuits 58 and 59 are each designed to have a transfer function represented by (Fmc·A'/2A). The elimination of the circuits 58 and 59 would result in a sound coming from the center stage of a reproduction field with a sound quality unaffected by the signal translation. The phase characteristic shown in FIG. 24 is obtained as a result of the combination of the characteristics of FIGS. 14 and 19.

The signal translator $SZ_c$ can be modified so that it constructed by a combination of the signal translators $SX_a$ and $SY_b$.

The embodiments of the present invention can also be modified so that they act as a localization network which permits a monophonic signal to be made to appear to come from a desired location regardless of the location of the loudspeaker.

Figure 26:
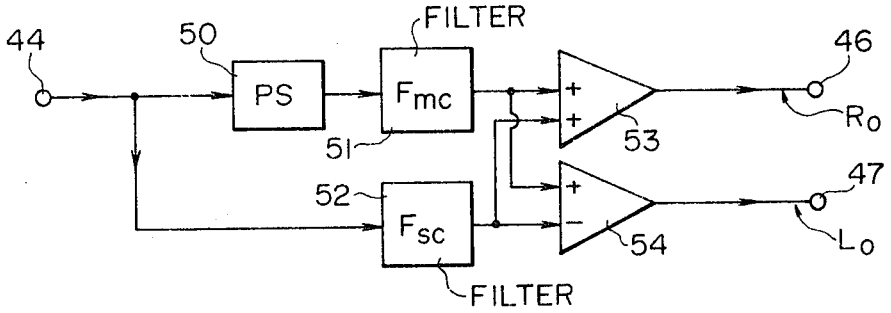
FIG. 26 is an illustration of a sonic localization network utilizing the transfer functions of the FIG. 21 embodiment.

FIG. 26 is a modification of the translator $SZ_c$ of FIG. 21 in which the adder 48, subtracter 49 and translating circuits 55 and 56 are eliminated from the arrangement of FIG. 21. In FIG. 26, a monophonic input signal is applied to the terminal 44 and thence to the translating circuit 51 via the phase shifter 50 and at the same time to the translating circuit 52, so that the input monophonic signal undergoes different signal translations and appears at the outputs terminals 46 and 47. If loudspeakers are connected to the output terminals 46 and 47, a listener sitting in front of the speakers would hear sound coming from a location determined by the translation functions of the two translating circuits 51 and 52.

FIG. 27*a* is a modification of the translator $SX_a$ of FIG. 8 in which the monophonic signal is applied to the input terminal 1 and thence to the translating circuit 25 on the one hand and to the translating circuit 26 via the phase shifter 24 on the other hand. This monophonic signal undergoes simultaneous transformations and appears at the output terminals 3 and 4. The connection of a stereophonic headphone to the output terminals 3 and 4 would result in a sound coming from a location determined by the transfer functions of the translating circuits 25 and 26. In the arrangement of FIG. 27*a*, the listener would hear sound as if it comes from his right-hand side.

An arrangement shown in FIG. 27*b* includes an inverter 60 which is connected in the passage between the input terminal 1 and the phase shifter 24. This arrangement permits localization of sonic images on the left-hand side of the listener wearing a stereophonic headphone. A circuit shown in FIG. 27*c* is an alternative embodiment of FIG. 27*b*, which eliminates the inverter 60 and the circuit locations of the adder 27 and subtracter 28 are reversed.

The phase shifters included in the embodiments of FIGS. 15 to 27*c* may be dispensed with for the same reasons given in connection with the embodiment of FIG. 8.

What is claimed is:

1. An audio translator having a pair of first and second input terminals to which spatially correlated audio signals are respectively applied and a pair of first and second output terminals connected respectively to said first and second input terminals through first and second channels, comprising:

first and second adders each having a first input terminal and an output terminal connected in series in said first channel and each having a second input terminal connected to said second channel;

first and second subtracters each having a first input terminal and an output terminal connected in series in said second channel and each having a second input terminal connected to said first channel; and filter circuit means having a phase shift for translating the output of said first adder with a first transfer function describing the relationship between the output of said first adder and a summation of signals delivered to said first and second output terminals and for translating the output of said first subtracter with a second transfer function describing the relationship between the output of said first subtracter and a difference between said signals delivered to said first and second output terminals.

2. An audio translator as claimed in claim 1, wherein said filter circuit means comprises:

a first filter connected between said first and second adders and having a phase shift and a first transfer function describing the relationship between the output of said first adder and a summation of signals delivered to said first and second output terminals; and a second filter connected between said first and second subtractors and having a phase shift and a second transfer function describing the relationship between the output of said first subtracter and a difference between said signals delivered to said first and second output terminals.

3. An audio translator having a pair of first and second input terminals to which spatially correlated audio signals are respectively applied and a pair of first and second output terminals connected respectively to said first and second input terminals through first and second channels, comprising:

first and second adders each having a first input terminal and an output terminal connected in series in said first channel and each having a second input terminal connected to said second channel;

first and second subtracters each having a first input terminal and an output terminal connected in series in said second channel and each having a second input terminal connected to said first channel; and filter circuit means connected in one of said first and second channels and having a transfer function which is the division of a first transfer function by a second transfer function, said first transfer function describing the relationship between the output of said first adder and a summation of signals delivered to said first and second output terminals and said second transfer function describing the relationship between the output of said first subtractor and a difference between signals delivered to said first and second output terminals.

4. An audio translator as claimed in claim 3, further comprising second and third filter circuit means respectively connected in said first and second channels to the output terminals of said second adder and subtracter, each of said second and third filter circuit means having said second transfer function.

5. An audio translator as claimed in claims 1, 2, 3 or 4, wherein said first and second transfer functions are respectively represented by $$\left(1+\frac{B}{A}\right) \text{ and } \left(1-\frac{B}{A}\right),$$

where A is the transmission characteristic of an acoustic path between a loudspeaker and a listener's ear and B is the transmission characteristic of an acoustic path between said loudspeaker and the listener's other ear.

6. An audio translator as claimed in claims 1, 2, 3 or 4, wherein said first and second transfer function are respectively represented by $$1/\left(1+\frac{B}{A}\right) \text{ and } 1/\left(1-\frac{B}{A}\right),$$

where A is the transmission characteristic of an acoustic path betwen a loudspeaker and a listener's ear and B is the transmission characteristic of an acoustic path between said loudspeaker and the listener's other ear.

7. An audio translator as claimed in claim 5, further comprising a first output translating circuit having a transfer function A/2HP connected in said first channel to the output of said second adder and a second output translating circuit having the same transfer function as said first output translating circuit connected in said second channel to the output of said second subtracter, where HP is a frequency response characteristic of a stereophonic headphone.

8. An audio translator as claimed in claim 6, further comprising a first output translating circuit having a transfer function 1/2A connected in said first channel to the output of said second adder and a second output translating circuit having the same transfer function as said first output translating circuit connected in said second channel to the output of said second subtracter.

9. An audio translator as claimed in claim 7, further comprising a phase shifter connected in one of said first and second channels for providing a phase shift to lower frequency audio signals.

10. An audio translator as claimed in claim 8, further comprising a phase shifter connected in one of said first and second channels for providing a phase shift to lower frequency audio signals.

11. A sonic localization network having an input terminal to which an audio signal is applied and a pair of first and second output terminals, comprising:

a first filter having a first transfer function providing a phase shift to the audio signal applied to said input terminal;

a second filter having a second transfer function providing a phase shift to the audio signal applied to said input terminal;

an adder for providing an output signal representing a summation of the output signals of said first and second filters to said first output terminal; and a subtractor for providing an output signal representing a difference between said output signals of said first and second filters to said second output terminal.

12. A sonic localization network as claimed in claim 11, further comprising a phase shifter connected between said input terminal and one of said first and second filters for providing a phase shift to lower frequency audio signals.

* * * * *